US008646842B2

(12) United States Patent
Barfuss

(10) Patent No.: US 8,646,842 B2
(45) Date of Patent: Feb. 11, 2014

(54) SALON CHAIR HAVING POSITIONABLE SUPPORT

(76) Inventor: Linda Barfuss, Oak Harbor, WA (US)

( * ) Notice: Subject to any disclaimer, the term of this patent is extended or adjusted under 35 U.S.C. 154(b) by 291 days.

(21) Appl. No.: 13/164,670

(22) Filed: Jun. 20, 2011

(65) Prior Publication Data

US 2012/0319447 A1 Dec. 20, 2012

(51) Int. Cl.
*A47C 7/36* (2006.01)
*A47C 7/50* (2006.01)

(52) U.S. Cl.
USPC ..... 297/423.2; 297/284.9; 297/393; 297/397

(58) Field of Classification Search
USPC ..... 297/284.9, 393, 397, 423.19, 423.2, 297/423.23
See application file for complete search history.

(56) References Cited

U.S. PATENT DOCUMENTS

| | | | | | |
|---|---|---|---|---|---|
| 2,828,735 | A * | 4/1958 | Thompson | 297/392 |
| 3,643,996 | A * | 2/1972 | Carnahan | 297/410 |
| 4,619,483 | A * | 10/1986 | Dickey et al. | 297/397 |
| 5,010,898 | A * | 4/1991 | de Kanawati et al. | 128/845 |
| 5,149,173 | A * | 9/1992 | Jay et al. | 297/284.9 |
| 5,511,854 | A * | 4/1996 | Cordia | 297/393 |
| D374,368 | S * | 10/1996 | Sprigle et al. | D6/601 |
| 5,782,535 | A * | 7/1998 | Lafer | 297/423.36 |
| 6,270,160 | B1 * | 8/2001 | Blake | 297/393 |
| 6,827,400 | B2 * | 12/2004 | Menon et al. | 297/250.1 |
| 8,172,328 | B2 * | 5/2012 | Montiu | 297/397 |

* cited by examiner

*Primary Examiner* — Peter Brown
(74) *Attorney, Agent, or Firm* — Charles J. Rupnick

(57) ABSTRACT

A novel salon chair having a salon chair portion with a seat portion elevated above a floor surface on a support portion and a seat back portion. The novel salon chair also having one or both of: a side wing extended from the seat back portion adjacent to at least one of two opposite sides thereof and a top edge thereof, with the side wing being extended substantially over the seat portion; and an adjustable headrest structured for supporting a head of an occupant of the salon chair from falling.

17 Claims, 7 Drawing Sheets

SALON CHAIR HAVING POSITIONABLE SUPPORT

CLAIM OF PRIORITY

This application claims priority benefit of parent U.S. patent application Ser. No. 12/589,888 filed in the name of Linda Barfuss on Oct. 31, 2009, now allowed and to be issued as U.S. Pat. No. 7,963,610 on Jun. 21, 2011, the complete disclosure of which is incorporated herein by reference, and which application claims priority benefit of parent U.S. patent application Ser. No. 11/809,649 filed in the name of Linda Barfuss on Jun. 1, 2007, now issued U.S. Pat. No. 7,611,207 issued Nov. 3, 2009, the complete disclosure of which is also incorporated herein by reference.

FIELD OF THE INVENTION

The present invention relates generally to salon or styling chairs, and in particular to salon or styling chairs having movable footrest assemblies.

BACKGROUND OF THE INVENTION

Salon chairs are widely used by beauticians and other individuals performing hairdressing or other service for a patron seated in such chairs. As taught by Zvonik in U.S. Pat. No. 5,494,334, which is incorporated in its entirety herein by reference, salon or styling chairs having stationary footrest assemblies are generally well-known. A typical salon chair having a rigid tubular U-shaped footrest is depicted by Rodas in U.S. Pat. No. 4,995,670, which is incorporated in its entirety herein by reference. Rodas additionally teaches a circular hairdresser footrest which is connectable around the base of the salon chair for supporting the hairdresser's foot while working on a customer seated in a salon chair.

However, as taught by Zvonik, the patron may have difficulty taking a seated position in these prior art salon chairs. The user must either step over the horizontal foot-engaging and supporting portion of the rigid U-shaped footrest, or stand in front of the salon chair with the backs of the ankles against the horizontal foot engaging portion and then literally fall backward into the chair. Users with ambulatory problems, particularly the elderly or infirm, have a great deal of difficulty both getting into and out of these chairs because of the rigid immovable nature of these conventional footrests.

Furthermore, in dealings with the elderly and infirm, for example in an assisted living arena, the salon chair is experienced not only by the patron entering and leaving the chair. The salon chair is often also experienced by one or more caregivers and the operator. Caregivers experience the salon chair while assisting the patron into and out of the chair; caregivers may even have to lift the patron between a wheel chair and the salon chair. The operator experiences the salon chair while grooming or otherwise servicing the patron.

Zvonik and others have provided various apparatus intended to overcome this seating challenge. However, known footrest assemblies for salon chairs are limited in their ability to provide a comfortable movable footrest assembly that operates simply, efficiently and safely. Unfortunately, the footrest assembly taught by Zvonik, as well as other known footrest assemblies for salon chairs, consistently leaves at least a portion of the footrest or footrest support extended in front of the chair, even when the actual footrest is moved into a non-use position. These extended portions of the footrest assembly present a danger to the caregiver and operator alike, who may become entangled in them or even trip over them, hurting themselves and endangering others, including the elderly or infirm patron.

SUMMARY OF THE INVENTION

The present invention is a novel salon chair having a novel movable footrest assembly with a sliding or pivoting footrest which replaces a conventional rigid tubular one-piece footrest typical of salon chairs.

According to one aspect of the novel salon chair, the salon chair includes a chair portion structured for being elevated above a floor surface, the chair portion having a seat portion elevated on a support portion and a seat back portion. A footrest portion has a foot support portion that is movable between an extended configuration relative to the seat portion of the chair portion, and a retracted configuration relative thereto. An actuator mechanism coupled between the chair portion and the footrest portion is structured for moving the foot support portion between the extended and retracted configurations.

According to another aspect of the novel salon chair, the salon chair further includes a guide mechanism fixed between the chair portion and the footrest portion, the guide mechanism being structured for guiding the footrest portion between the extended and retracted configurations.

According to another aspect of the novel salon chair, the guide mechanism further includes one or more guides fixed relative to either the support portion of the chair portion or an underside surface of the seat portion thereof.

According to another aspect of the novel salon chair, the actuator mechanism further includes a linkage mechanism coupled between the chair portion and the footrest portion.

According to another aspect of the novel salon chair, the footrest portion further includes a leg portion angularly extended away from the seat portion and terminating in the foot support portion distal from the seat portion. The guide mechanism further includes a translational guide mechanism structured for translating the leg and foot support portions relative to the chair portion.

According to another aspect of the novel salon chair, the footrest portion further includes a sled portion angularly extended from the leg portion adjacent to the underside of the seat portion of the chair portion. The translational guide mechanism further includes a track extended adjacent to the underside of the seat portion of the chair portion, translational guide mechanism being structured to receive the sled portion of the footrest portion in a translational manner. According to another aspect of the novel salon chair, the sled portion of the footrest portion is further received by the track portion of the translational guide mechanism in a sliding manner.

According to another aspect of the novel salon chair, the footrest portion is further formed with a knee portion adjacent to the seat portion; and the guide mechanism further includes a pivotal guide mechanism interfaced between the knee portion and the chair portion, the pivotal guide mechanism being structured for pivoting the footrest portion relative to the chair portion.

Other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF PREFERRED EMBODIMENT

In the Figures, like numerals indicate like elements.

Figure 1:
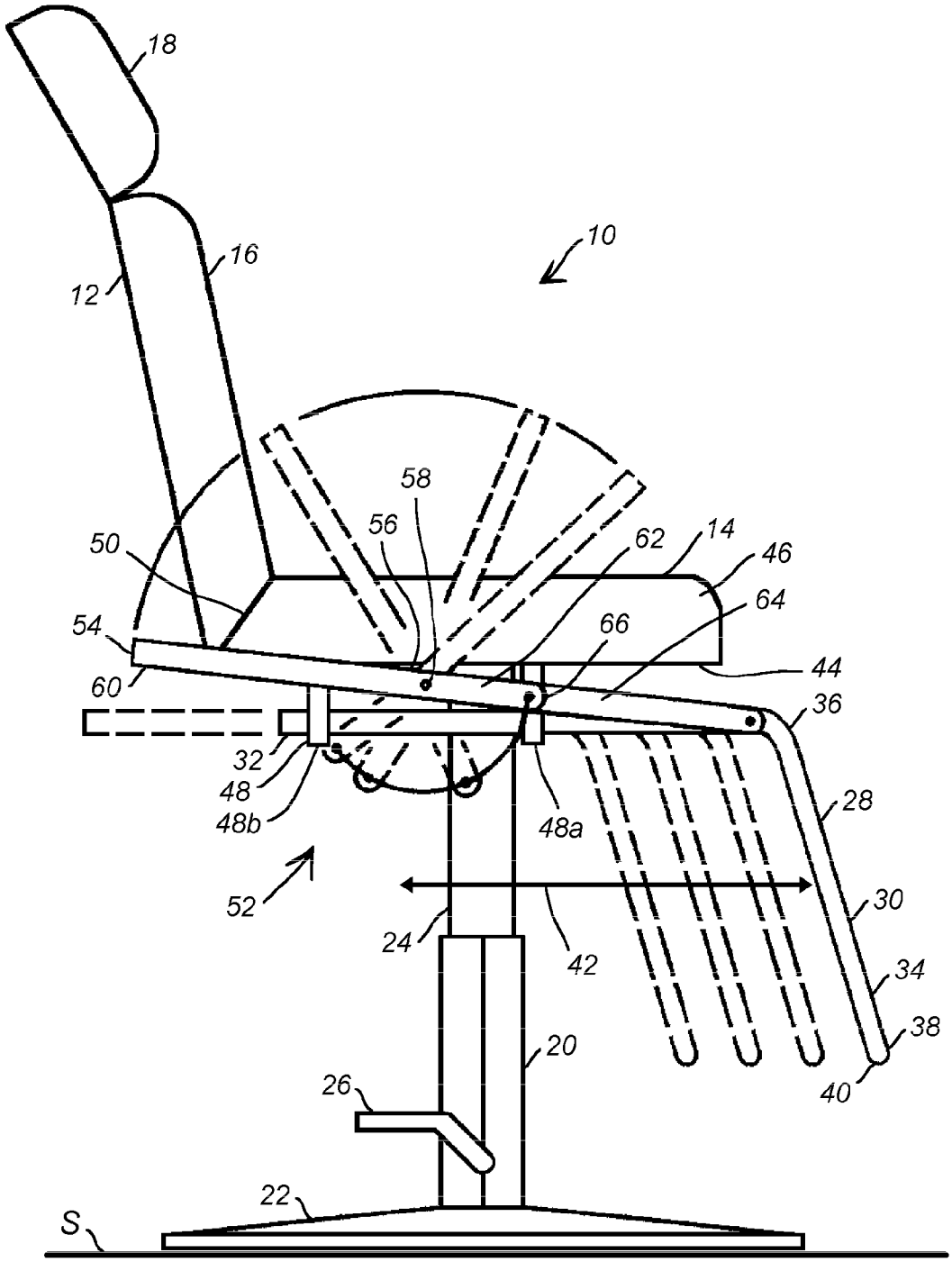
FIG. 1 illustrates an example of a salon chair having the novel movable footrest assembly.

FIG. 1 illustrates an example of a novel salon chair 10 having a salon chair portion 12 including a substantially horizontal seat 14 from which depends seat back 16 which may be reclinable in a multipurpose chair or fixed substantially upright in a conventional styling chair. A head rest 18 is optional. The salon chair 10 is expected to be supported on a pedestal 20 having for example a circular base 22 that engages a horizontal floor surface S and a post 24 that supports the salon chair portion 12. The support post 24 is optionally included as part of a seat elevation adjustment mechanism 26 for adjustably positioning the seat with the patron at a convenient elevation for the hairdresser or other service provider. If present, the elevation adjustment mechanism 26 is, by example and without limitation, a mechanical or pneumatic drive mechanism of a conventional type that is generally well-known for use with conventional salon chairs, or another such mechanism 26.

The novel salon chair 10 further includes a novel movable footrest assembly 28 illustrated here in a fully deployed position for supporting the patron's feet. The novel footrest assembly 28 includes a substantially rigid tubular footrest portion 30 for supporting the patron's feet. The footrest portion 30 includes a sled portion 32 extended under the horizontal chair seat 14 and a generally U-shaped or C-shaped leg portion 34 extended at a knee portion 36 and angularly canted away from the chair seat 14 and toward the floor S. The leg portion 34 thus accommodates the patron's feet below and in front of the salon chair 10. The leg portion 34 terminates at a free end 38 in a foot support portion 40, more clearly illustrated in FIGS. 2 and 3, which is elevated above the floor surface S to aid the patron in mounting the chair portion 12.

The sled portion 32 is structured to follow a course 42 that substantially follows along an under surface 44 of the chair seat 14 and leads the leg portion 34 between a position adjacent to or extended beyond a front portion 46 of the chair seat 14 and a position retracted under the chair seat 14, for example near to the chair pedestal 20. By example and without limitation, the course 42 is embodied by one or more tracks or guide ways 48 provided in a position substantially under the salon chair portion 12 and substantially immobile or fixed relative to the chair seat 14 or the chair pedestal 20. The sled portion 32 is structured to move along the one or more tracks or guide ways 48 to follow the course 42 under the chair seat 14. For example, the sled portion 32 is structured to be received by the tracks or guide ways 48 and to slide along them. The sled portion 32 either fits inside the tracks or guide ways 48 or wraps around outside them. Stiction is avoided or eliminated using appropriate bushings between the sled portion 32 and the tracks or guide ways 48. Alternatively, the sled portion 32 is structured to roll along the tracks or guide ways 48 on rollers such as ball bearings, or on wheels. By example and without limitation, the tracks or guide ways 48 are connected or otherwise provided adjacent to the under surface 44 of the chair seat 14. Optionally, the tracks or guide ways 48 are provided on the chair pedestal 20, for example on the support post 24 adjacent to the under surface 44 of the chair seat 14. As illustrated, two substantially parallel tracks or guide ways 48 are connected to the chair seat under surface 44 and projected from a portion thereof. Here, the tracks or guide ways 48 are illustrated as being spaced apart on opposite sides of the support post 24 portion of the chair pedestal 20. Furthermore, by example and without limitation the tracks or guide ways 48 are optionally formed by two sets of guide ways 48*a* and 48*b* on the chair seat under surface 44 at spaced apart positions forward of the chair pedestal 20 toward the front portion 46 of the chair seat, and aft of the chair pedestal 20 adjacent to a rear portion 50 of the chair seat 14. This optional configuration of the tracks or guide ways 48 effectively ensures the sled portion 32 follows the course 42 smoothly without excessive binding or sticking. Motion of the sled portion 32 of the footrest portion 30 effectively translates the leg portion 34 and foot support portion 40 at its free end 38 between the extended position adjacent to or in front of the front portion 46 of the chair seat 14 for use by the patron mounting the chair portion 12, and the retracted position under the chair seat 14 where it is out of the patron's way when stepping out of the chair portion 12.

By example and without limitation, the novel footrest assembly 28 is actuated by means of a novel linkage mechanism 52 coupled to the footrest portion 30. However, other means for actuating the footrest assembly 28 for moving the footrest portion 30 between the extended and retracted positions of the leg portion 34 and foot support portion 40 are also contemplated and may be included without deviating from the scope and intent of the present invention. For example, the novel footrest assembly 28 is alternatively actuated by means of a crank or an electric motor operating a conventional chain or screw drive, or a hydraulic or pneumatic cylinder pulling and pushing the footrest portion 30 either directly or through a linkage mechanism.

The linkage mechanism 52 as illustrated here by example and without limitation includes a substantially rigid lever arm 54 having a rotation portion 56 pivotable about a fulcrum mechanism 58, such as a pin (FIGS. 1, 2, 3) or rod (FIGS. 4, 5), that is fixed in a substantially stationary position relative to the chair seat under surface 44. A longer control arm portion 60 of the lever arm 54 extends from the rotation portion 56 into a range reachable by an operator of the salon chair 10; for example, the control arm portion 60 extends generally above the chair seat 14, as illustrated. However, the control arm portion 60 could just as easily optionally extend into a range nearer the floor surface S, and thereby avoid interference with the operator. The lever arm 54 includes a second shorter drive arm portion 62 extended from the rotation portion 56 into a range adjacent to the movable footrest assembly 28. A substantially rigid drive rod 64 is pivotably coupled between an end 66 of the drive arm portion 62 of the lever arm 54 distal from the rotation portion 56 and the footrest portion 30. By example and without limitation, the drive rod 64 is pivotably coupled to the footrest portion 30 near the knee portion 36 between the sled portion 32 and the leg portion 34.

FIG. 1 also illustrates operation of the novel salon chair 10. Well-known mechanics cause the footrest portion 30 to move along the course 42 when the linkage mechanism 52 is operated. For example, as illustrated by phantom lines, manual rotation of the longer control arm portion 60 of the lever arm 54 about the fulcrum mechanism 58 simultaneously rotates the shorter drive arm portion 62 attached to the rotation portion 56. The drive arm portion 62 pushes or pulls the footrest portion 30 through the interconnecting drive rod 64, and the footrest portion 30 moves along the course 42 between the extended and retracted positions, as illustrated by the phantom lines.

Figure 2:
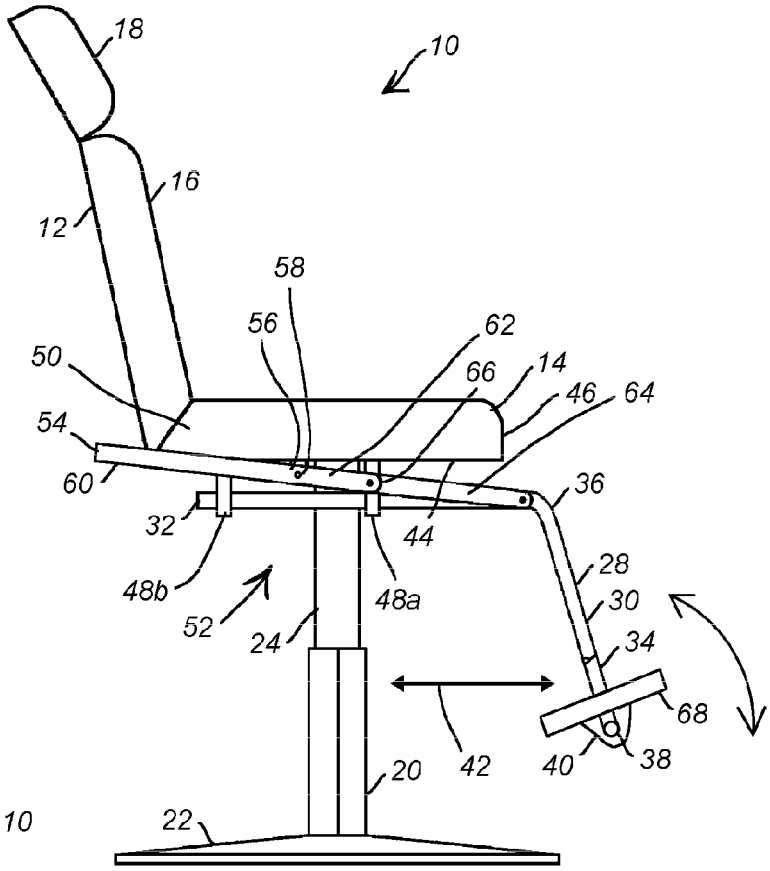
FIG. 2 illustrates by example and without limitation an extended position of a novel linkage mechanism and interconnected footrest portion of the novel movable footrest assembly.
Figure 3:
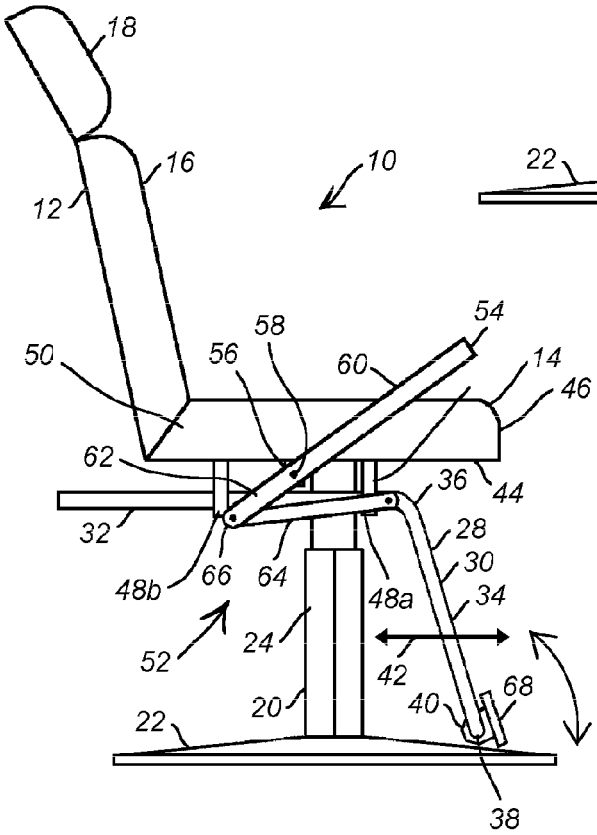
FIG. 3 illustrates by example and without limitation a retracted position of a novel linkage mechanism and interconnected footrest portion of the novel movable footrest assembly.

FIGS. 2 and 3 illustrate the extended and retracted positions, respectively, of the linkage mechanism 52 and interconnected footrest portion 30 of the novel movable footrest assembly 28. Furthermore, the foot support portion 40 is illustrated as a foot plate support 68 that is either fixed to the leg portion 34, else pivoted (arrows) there about either by foot or by hand from an in-use substantially horizontal position (FIG. 2) to a deflected out-of-the-way or non-use position against the canted leg portion 34 (FIG. 3). By this arrangement, the elderly and ambulatory-impaired users may easily step up the salon chair portion 12 for seating when the foot plate support 68 is in the deflected non-use position and then they, themselves or an assistant may then pivot the foot plate support 68 downwardly into the substantially horizontal in-use position.

Figure 4:
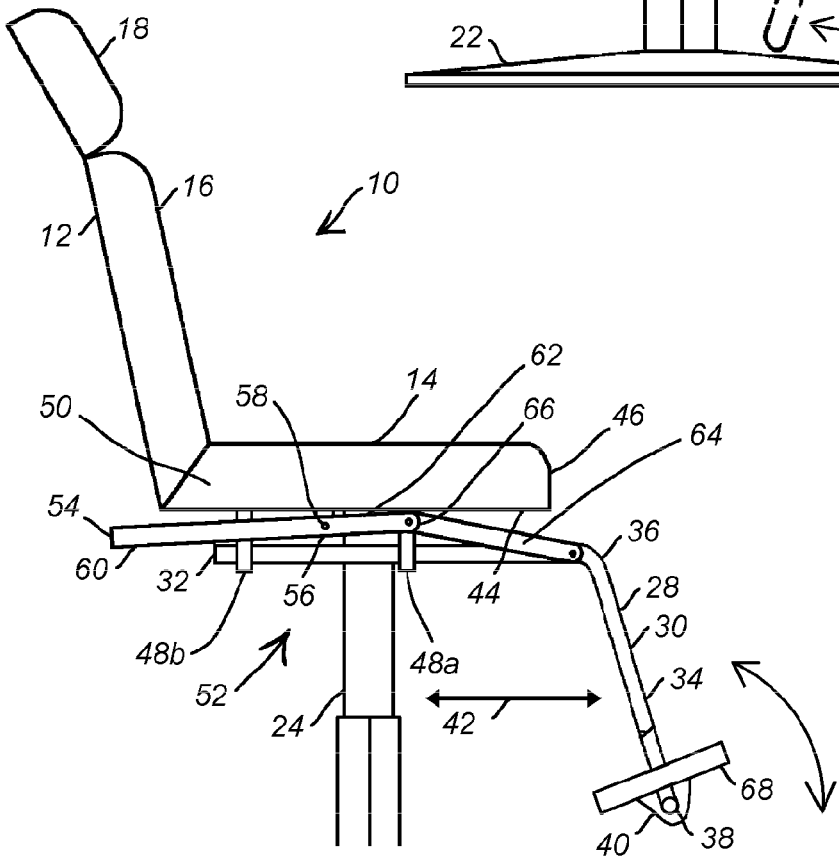
FIG. 4 illustrates by example and without limitation one footrest locking mechanism operable in the extended position of the movable footrest assembly.

FIG. 4 illustrates one footrest locking mechanism operable in the extended position of the movable footrest assembly 28. By example and without limitation, the linkage mechanism 52 is in an over-center locking configuration, whereby the footrest portion 30 cannot be accidentally retracted. Other footrest locking mechanisms are also contemplated and may be included without deviating from the scope and intent of the present invention. For example, pins or friction mechanisms can be used to retain the footrest portion 30 against unintentional retraction.

Figure 5:
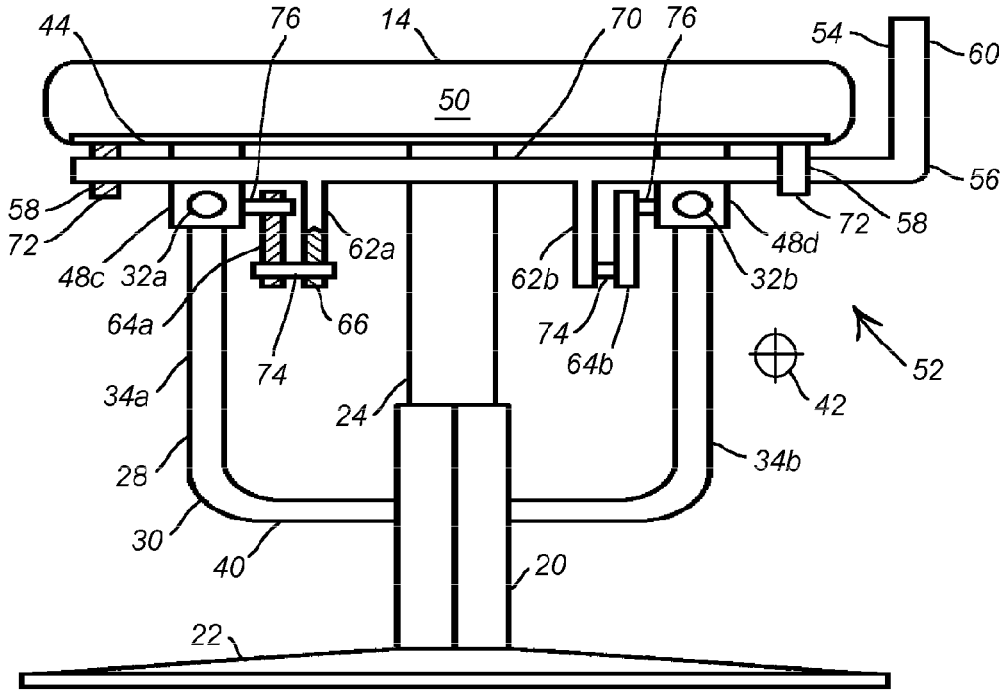
FIG. 5 is a rear view of one exemplary embodiment of the novel salon chair wherein the seat back and optional head rest are removed from the seat portion of the salon chair portion for clarity.
Figure 6:
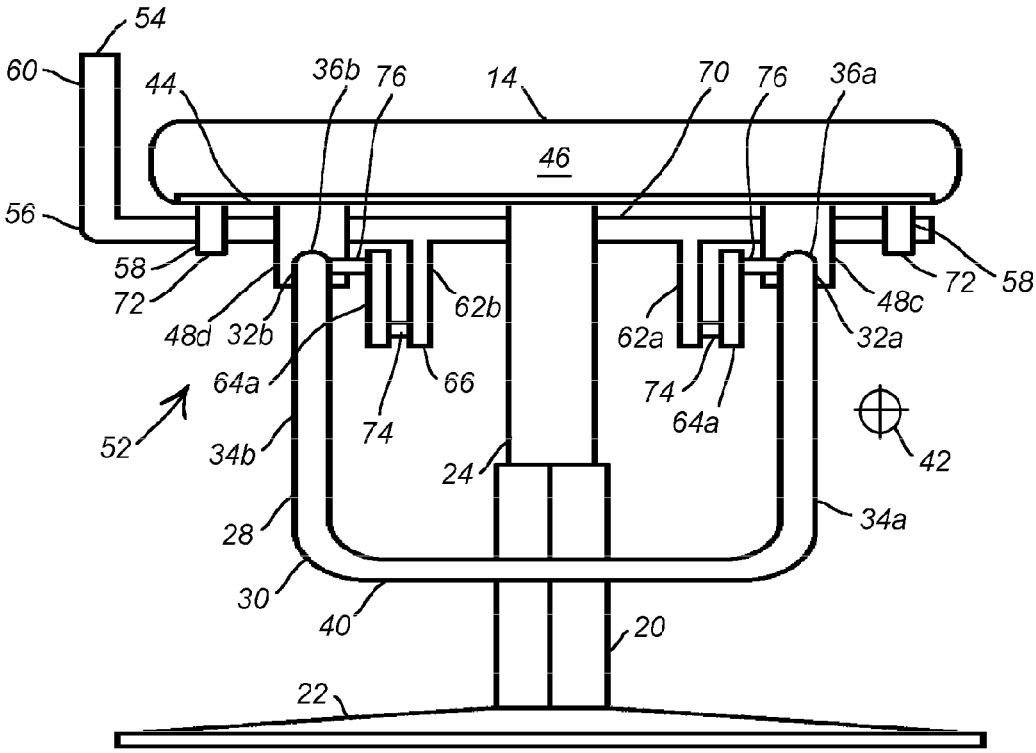
FIG. 6 is a front view of one exemplary embodiment of the novel salon chair wherein the seat back and optional head rest are removed from the seat portion of the salon chair portion for clarity.

FIGS. 5 and 6 are rear and front views, respectively, of one embodiment of the novel salon chair 10 wherein the seat back 16 and optional head rest 18 are removed from the seat portion 14 of the salon chair portion 12. The tracks or guide ways 48 are illustrated here by example and without limitation as the two sets of guide ways 48*a* and 48*b* on the chair seat under surface 44 at spaced apart positions forward (FIG. 6) of the chair pedestal 20 toward the front portion 46 of the chair seat, and aft (FIG. 5) of the chair pedestal 20 adjacent to the rear portion 50 of the chair seat 14. As discussed herein, this optional configuration of the tracks or guide ways 48 effectively ensures the sled portion 32 follows the course 42 smoothly without excessive binding or sticking while translating the leg portion 34 of the footrest portion 30 between the extended and retracted positions. Furthermore, as illustrated here by example and without limitation, the two sets of guide ways 48*a* and 48*b* are further structured as two sets of two sets of guide ways 48*c* and 48*d* on the left and right of the pedestal 20. The sled portion 32 is structured as a pair of spaced-apart sleds 32*a* and 32*b* each slidably mounted both the front and aft guide ways 48*a*, 48*b* in one of the two sets of left and right guide ways 48*c* and 48*d*. Thus, the pair of sleds 32*a*, 32*b* follow the course 42 substantially along the under surface 44 of the chair seat 14. The leg portion further includes a pair of leg portions 34*a* and 34*b* each extended at knee portion 36*a* and 36*b* from the sled portions 32*a*, 32*b*, respectively. The leg portions 34*a*, 34*b* each terminate at respective free ends 38*a* and 38*b* with the foot support portion 40 extended between them.

Here, the fulcrum mechanism 58 of the linkage mechanism 52 is illustrated by example and without limitation being configured as a rod 70 that is rotatable in a pair of blocks 72 spaced on either side of the chair seat portion 14 and fixed to the chair seat under surface 44. Appropriate bushings are optionally inserted between the rod 70 and blocks 72 to ensure smooth rotation. The longer control arm portion 60 of the lever arm 54 optionally extends rigidly from the rotation portion 56 adjacent to one end of the rod 70, and is optionally an extension of the rod 70 portion of the fulcrum mechanism 58. The second shorter drive arm portion 62 of the lever arm 54 is optionally rigidly extended from the rotation portion 56 as a pair of spaced-apart drive arm portions 62*a* and 62*b* adjacent to respective spaced-apart sled portions 32*a*, 32*b*. The drive rod 64 is structured as a pair of drive rods 64*a* and 64*b* pivotably coupled between the respective drive arm portions 62*a*, 62*b* of the lever arm 54 and the footrest portion 30 by pins 74. By example and without limitation, pins 76 couple the drive rods 64*a*, 64*b* to the respective leg portions 34*a*, 34*b* of the footrest portion 30 adjacent to the respective knee portions 36*a*, 36*b*. However, the drive rods 64*a*, 64*b* are optionally coupled to the footrest portion 30 elsewhere than the knee portions 36*a*, 36*b* without deviating from the scope and intent of the present invention. For example, the drive rods 64*a*, 64*b* are optionally coupled to the respective leg portions 34*a*, 34*b* of the footrest portion 30 between the respective knee portions 36*a*, 36*b* and the free ends 38*a*, 38*b* without deviating from the scope and intent of the present invention. Else, the drive rods 64*a*, 64*b* are optionally coupled to the respective sled portions 32*a*, 32*b* between the two sets of guide ways 48*a* and 48*b* also without deviating from the scope and intent of the present invention. The moving parts of the linkage mechanism 52 is thus primarily hidden under the chair seat 14 so it is out of the way and does not endanger the patron nor caregiver nor operator. In a practical application of the novel linkage mechanism 52, the lever arm 54 is discretely proportioned and effectively protected to avoid accidental interference with either a caregiver assisting the patron or the operator during performance of service.

Figure 7:
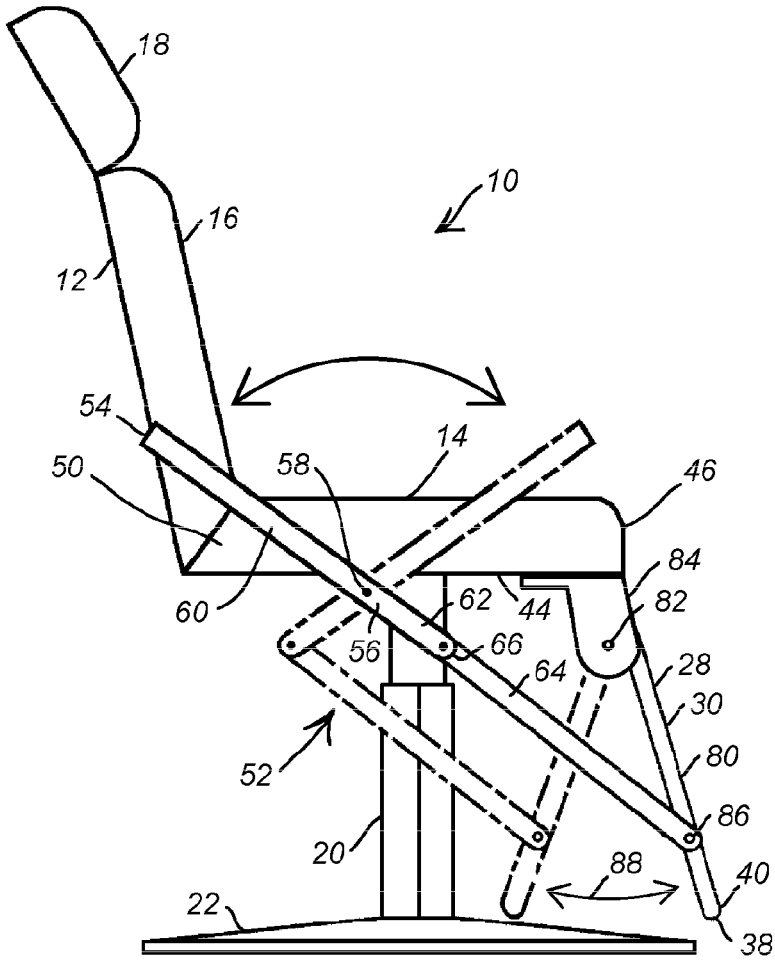
FIG. 7 illustrates by example and without limitation another embodiment of the novel salon chair wherein the novel movable footrest assembly is operable in a pivoting configuration rather than the translating configuration illustrated in previous Figures.

FIG. 7 illustrates another embodiment of the novel salon chair 10 wherein the novel movable footrest assembly 28 is operable in a pivoting configuration rather than the translating configuration illustrated in previous Figures. By example and without limitation, the novel movable footrest assembly 28 includes a pivotable footrest portion 78 having a generally U-shaped or C-shaped leg portion 80 pivotably suspended by one or more pins 82 from a substantially stationary bracket 84 fixed relative to the chair seat 14, for example, connected to either the chair seat under surface 44, or the chair pedestal 20.

The linkage mechanism 52 includes the substantially rigid lever arm 54 having the rotation portion 56 pivotable about the fulcrum mechanism 58. The lever arm 54 includes the longer control arm portion 60 and the second shorter drive arm portion 62 extended from the rotation portion 56. The substantially rigid drive rod 64 is pivotably coupled between the distal end 66 of the drive arm portion 62 and the pivotable footrest portion 78 of the novel movable footrest assembly 28. By example and without limitation, the drive rod 64 is pivotably coupled to the leg portion 80 by one or more pins 86.

The position for the one or more pins 86 coupling the drive rod 64 to the leg portion 80 is selected such that the leg portion 80 of the pivotable footrest portion 78 is structured to swing in a arcing course 88 between a position adjacent to or extended beyond the front portion 46 of the chair seat 14 and a position retracted under the chair seat 14, for example near to the chair pedestal 20.

Furthermore, by example and without limitation, the linkage mechanism 52 is illustrated here in a slightly over-center locking configuration, whereby the pivotable footrest portion 78 cannot be accidentally retracted. Other footrest locking mechanisms are also contemplated and may be included without deviating from the scope and intent of the present invention. For example, pins or friction mechanisms can be used to retain the pivotable footrest portion 78 against unintentional retraction.

Client Support

Figure 8:
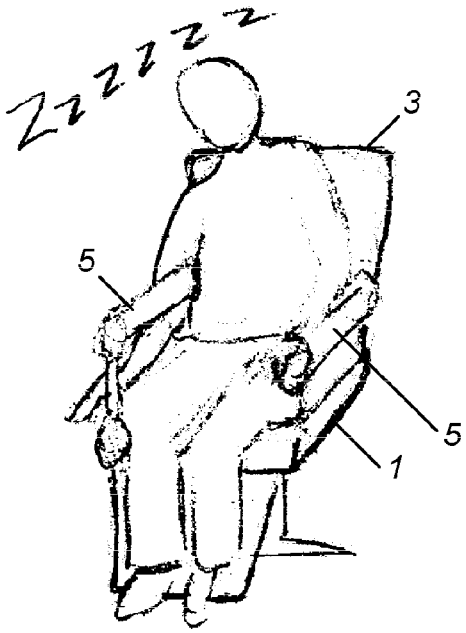
FIG. 8 illustrates a problem experienced using salon chairs of the prior art.

FIG. 8 illustrates a problem experienced using salon chairs of the prior art. Namely, known salon chairs 1 always have a straight seat back 3 to provide the hairdresser easy access to the hairdressing client. Therefore, the prior art clearly teaches away from any structure that potentially blocks access by the hairdresser to the hairdressing client. The problem arises from the straight chair back design of the prior art because, unfortunately, the elderly and infirm often do not have the strength and stamina to remain upright through the entire time required for the hairdresser to dress the client's hair. As a result, regardless of armrests 5 the client will often slump (shown) or even doze, especially during the later stages of hairdressing. Eventually, the client slips in the salon chair 1 and the head slumps sideways, which causes difficulties for the hairdresser to complete the hairdressing satisfactorily.

FIGS. 9 through 12 and FIG. 14 all illustrate a same novel salon chair 100 of the invention.

Figure 9:
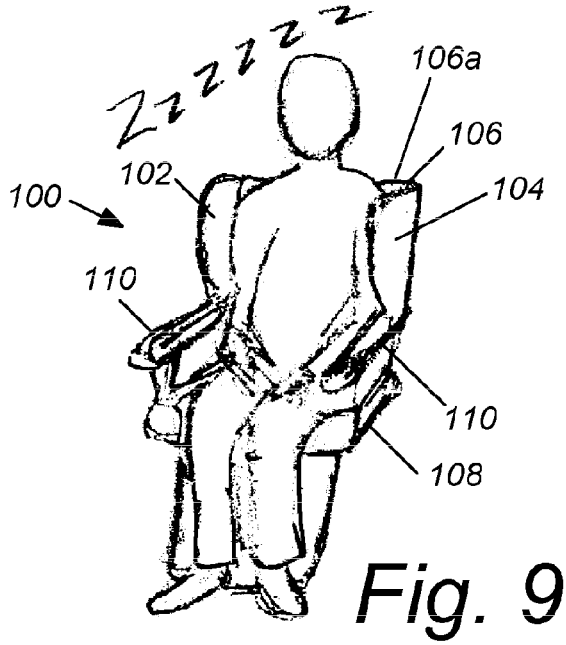
FIG. 9 illustrates operation of a novel salon chair of the invention having one or two side wings extended substantially forward from a seat back along the sides of the chair's seat above its armrests for supporting the hairdressing client in a substantially upright orientation.

FIG. 9 illustrates the operation of the novel salon chair 100 of the invention having one or two side wings 102, 104 extended substantially forward from a seat back 106 along the sides of the chair's seat 108 above its armrests 110 for supporting the hairdressing client in a substantially upright orientation. According to one embodiment, the side wings 102, 104 extend to substantially the full height of the seat back 106 up to its top edge 106*a* for providing maximum support at the client's shoulder level. Optionally, the side wings 102, 104 are permanent structures of the seat back 106, i.e., a wingback salon chair. However, the inventor has determined that a majority of elderly and infirm clients generally always lean to one side or the other, that is either left or right. Therefore, according to one embodiment, the side wings 102, 104 are optionally removable from the seat back 106. Optionally, a single side wing 102 is removable and relocatable between the right side and opposite left side of the seat back 106 of the salon chair 100. Accordingly, the client is held substantially upright by leaning against one of the side wings 102, 104.

The side wings 102, 104 are optionally used either in combination with, or independently of, the salon chair 10 illustrated herein having the novel movable footrest assembly 28 disclosed herein.

Figure 10:
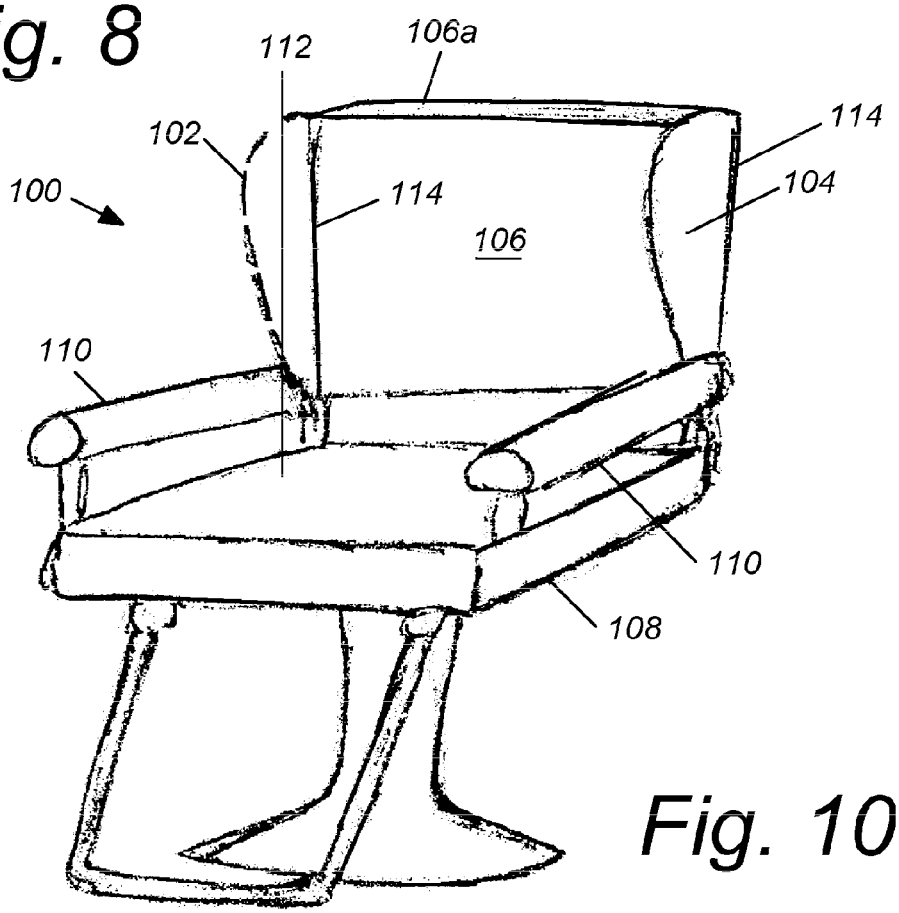
FIG. 10 illustrates the novel salon chair without the hairdressing client, the salon chair having both of the pair of side wings extended substantially forward from the seat back above the armrests.

FIG. 10 illustrates the novel salon chair 100 with both side wings 102, 104 extended substantially forward from the seat back 106 above the armrests 110. One or more side wings 102, 104 effectively prop the client in a substantially upright orientation regardless of any tendency of the client toward slumping or even dozing, as illustrated in FIG. 9, and provide the hairdresser with sufficient access to complete the hairdressing satisfactorily.

As disclosed herein above, optionally a single side wing 102 is removable and relocatable between the right side and opposite left side of the seat back 106 of the salon chair 100. For example, the single side wing 102 is substantially symmetrical about a longitudinal axis 112 and padded and upholstered substantially equally on both sides. The single side wing 102, or a pair of the side wings 102, 104, is interconnectable with the seat back 106 along an interconnection defined by each of two cooperating releasable couplers 114 operable between the side wing 102 and the left and right sides of the seat back 106 for removably and attaching the side wing 102 to the left and right sides of the seat back 106. The releasable coupler 114 is provided on both the left and right sides of the seat back 106, whereby the pair of side wings 102, 104 are individually removable for providing access to the client. Alternatively, a single side wing 102 is removable and alternately relocatable between the right side and opposite left side of the seat back 106 of the salon chair 100, for example, as a function of which way the client generally leans.

The novel salon chair 100 of the invention with side wings 102, 104 illustrated in FIGS. 9 through 12 and FIG. 14 is illustrated in cooperation with the same novel movable footrest assembly 28 of the invention disclosed here and illustrated in all of FIGS. 1 through 7. However, any other conventional foot rests and foot rest assemblies of the prior art are also contemplated in cooperation with the novel salon chair 100 having side wings 102, 104 and may be substituted without deviating from the scope and intent of the present invention.

Figure 12:
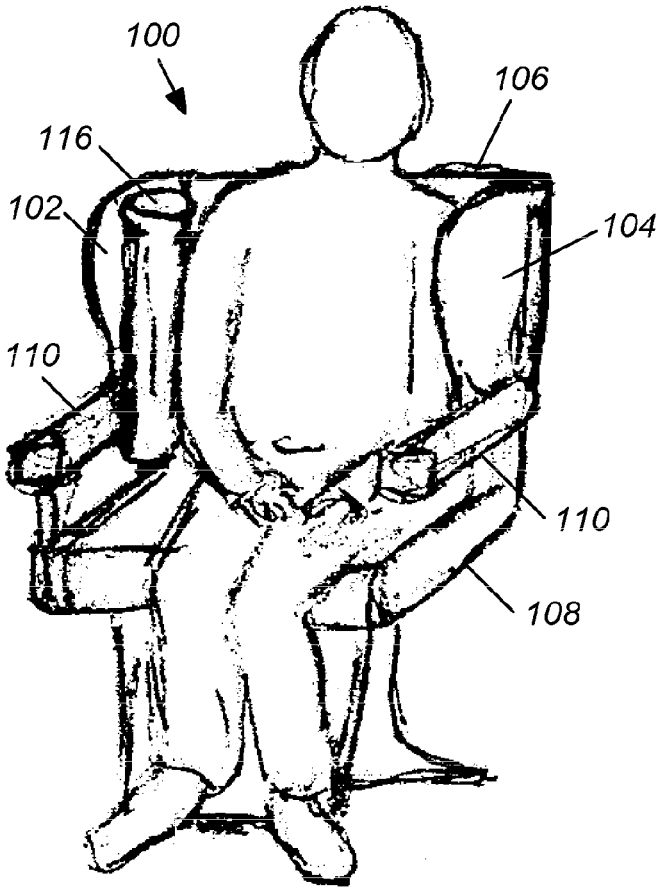
FIG. 12 illustrates an example of one of the substantially cylindrical bolster cushions tucked between the hairdressing client and the side wing during a hairdressing session.
Figure 11:
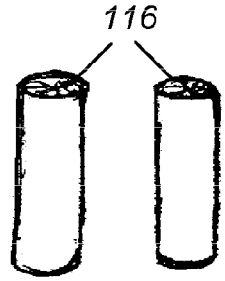
FIG. 11 illustrates two substantially cylindrical bolster cushions of the invention for use with the novel salon chair.
Figure 13:
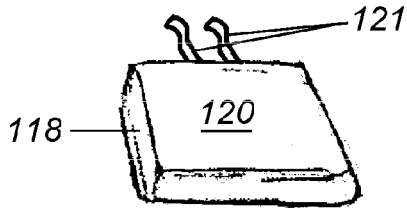
FIG. 13 illustrates a flat seat bolster cushion for use with the novel salon chair.

FIG. 11 illustrates two substantially cylindrical shoulder bolster cushions 116 for use with the salon chair 100. FIG. 12, for example, illustrates one of the substantially cylindrical shoulder bolster cushions 116 in a position tucked between the hairdressing client and the side wing 102 of the salon chair 100 during a hairdressing session. Thus positioned the shoulder bolster cushion 116 effectively props the client in the salon chair 100 to avoid the problematic slumping due to tiredness and fatigue often experienced by the elderly and infirm. The inventor is not aware of any instance in the prior art of such a cylindrical bolster cushion being positioned between the client and the side wing 102 for propping the client in a salon chair during hairdressing. The inventor is a hairdresser of long standing with extensive experience in geriatric facilities and understands that it is important to the hair FIG. 13 illustrates a flat seat bolster cushion 118 for use with the salon chair 100. The substantially flat seat bolster cushion 118 is optionally substantially rectangular in shape. According to one embodiment, the seat bolster cushion 118 is formed with one non-slip surface 120 (nominally a bottom surface) whereby the seat bolster cushion 118 is restricted from slipping in the salon chair 100 during use. For example, the non-slip surface 120 of the seat cushion 118 is a rubber or silicone fabric that resists slipping relative to conventional salon chair fabrics. Alternatively, the seat cushion 118 utilizes another non-slip mechanism 121, such as ties, that attach to the chair's seat 108 or seat back 106. Such alternative non-slip mechanism 121 are also contemplated and may be substituted without deviating from the scope and intent of the present invention.

Figure 14:
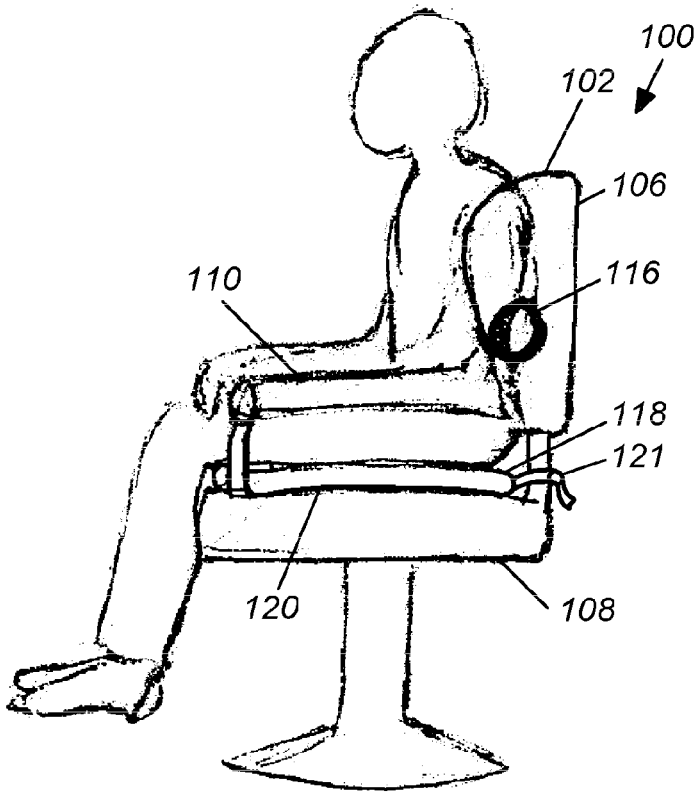
FIG. 14 illustrates the seat bolster cushion positioned under a client during a hairdressing session.

FIG. 14 illustrates the same novel salon chair 100 of the invention that is illustrated in all of FIGS. 9 through 12.

FIG. 14 illustrates the seat bolster cushion 118 positioned under a client during a hairdressing session, whereby client is raised in the salon chair 100 above the nominal chair seat 108 for better access by the hairdresser. The seat bolster cushion 118 also effectively raises the client relative to the side wings 102, 104 if the client is short in the salon chair 100. Here, the seat bolster cushion 118 is positioned with the non-slip surface 120 against the chair seat 108 to more effectively resist slippage in the salon chair 100 during use. Alternatively, when present, the other non-slip mechanism 121, such as ties, are attached to the chair's seat 108 or seat back 106 (shown). Additionally, one of the substantially cylindrical shoulder bolster cushions 116 is positioned between the client's shoulder and the seat back 106 for back support of the client. The one or more side wings 102, 104, the substantially cylindrical shoulder bolster cushions 116, and the seat bolster cushion 118 are thus used alone or in combination to support the client in the salon chair 100 during hairdressing.

Figure 15:
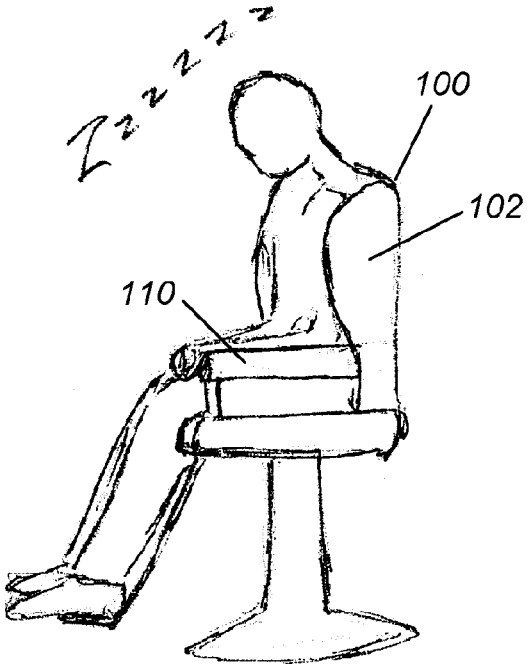
FIG. 15 illustrates another problem experienced using salon chairs of the prior art that occurs when the tired hairdressing client slumps forward, rather than to one side as illustrated in FIG. 8.

FIG. 15 illustrates another problem experienced using salon chairs of the prior art that occurs when the tired hairdressing client slumps forward, rather than to one side. Here, the client may drop the chin onto the chest, which causes difficulties similar to the side slump for the hairdresser to complete the hairdressing satisfactorily. Additionally, slumping forward can cause the client to fall forward out of the salon chair 100, regardless of the presence of the side wings 102, 104 and armrests 110, which is dangerous for the client.

Figure 16:
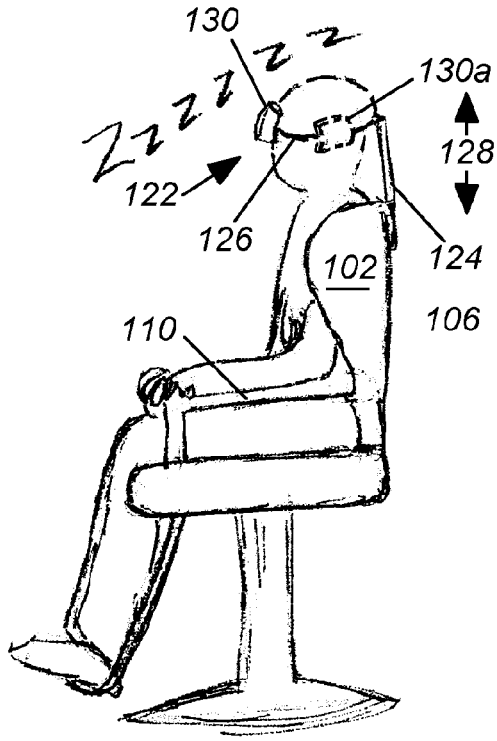
FIG. 16 illustrates a novel adjustable headrest for supporting the hairdressing client's head from falling either forward, or to either side, during a hairdressing session.

FIG. 16 illustrates a novel adjustable headrest 122 for supporting the client's head from falling either forward, or to either side, during a hairdressing session. Here, the novel adjustable headrest 122 is illustrated as having a support rod 124 suspending a substantially arcuate suspension ring 126 formed, for example, as a partial hoop. The support rod 124 is extended substantially vertically from the salon chair 100 and is vertically adjustable (arrow 128) relative to the seat back 106 for adjusting height of the suspension ring 126 and the position of a comfortable support pad 130 supported thereon. The support pad 130 is padded and may be washable, and is optionally removable from the suspension ring 126 for cleaning, repair or replacement. Optionally, the support pad 130 is movable along the suspension ring 126 into one or more different positions 130*a* (shown dashed) for supporting the client's head at different points, for example by sliding or detachment and reattachment, to provide the hairdresser with access during the hairdressing session. The support rod 124 is adjustable 128 relative to the salon chair 100 for positioning the suspension ring 126 and support pad 130 at different heights above the seat back 106, for example, for different heights of the client in the salon chair 100.

Although shown with the side wings 102, 104, the headrest 122 is optionally used independently of the side wings 102, 104, for example in a salon chair of the prior art, or with the salon chair 10 illustrated herein having novel movable footrest assembly 28 disclosed herein.

Figure 17:
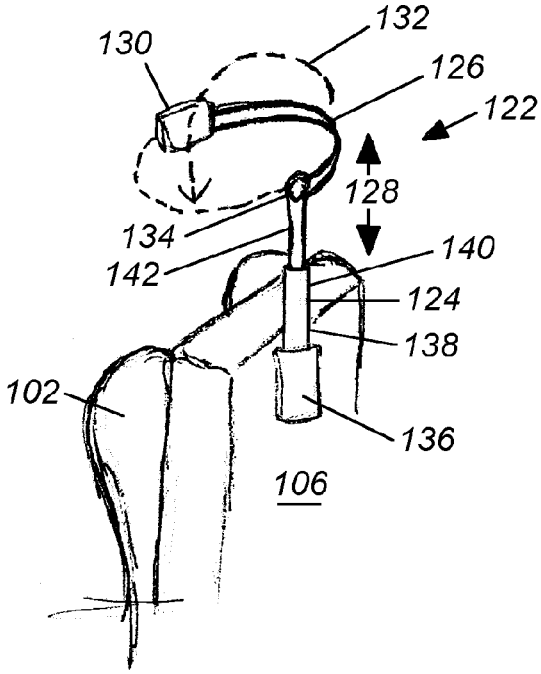
FIG. 17 illustrates a novel reversible feature of the novel headrest.

FIG. 17 illustrates a novel reversible feature (arrow 132) of the headrest 122. According to one option, the partial hoop suspension ring 126 of the headrest 122 is rotatable relative to the support rod 124 for positioning the suspension ring 126 and support pad 130 on different opposing sides of the support rod 124. When the suspension ring 126 is positioned on different sides of the support rod 124, the support pad 130 is optionally positioned for engaging the client's head on either the right or left side. This reversible feature of the headrest 122 permits the support pad 130 to engage the client's head at the side the client most generally slumps or tilts, thereby retaining the client's head in a substantially upright orientation. By example and without limitation, a hinge or pivot 134 is positioned between the suspension ring 126 and support rod 124 for reversibly rotating the suspension ring 126 to opposite sides of the support rod 124, whereby the support pad is positioned to alternately engage opposite right and left sides of the client's head. This reversible feature of the headrest 122 also permits the support pad 130 to engage the client's head for access to the client's head during hairdressing.

The suspension ring 126 is also illustrated alternatively as either a thin rod (FIG. 16) or a wider band (here) is also contemplated and may be substituted without deviating from the scope and intent of the present invention.

The seat back 106 is optionally fitted with a receiver bracket 136 for receiving a foot portion 138 of the support rod 124 distal from the suspension ring 126 and support pad 130. For example, the receiver bracket 136 is fixed approximately halfway across the seat back 106 and may be at any height thereon. The support rod 124 is optionally either telescopically adjustable in length with telescopingly interconnected sections 140, 142 for positioning the height of the suspension ring 126 and support pad 130, or else is lengthwise repositionable within the receiver bracket 136. Both the telescoping and lengthwise repositionable options are contemplated and may be substituted without deviating from the scope and intent of the present invention.

Figure 18:
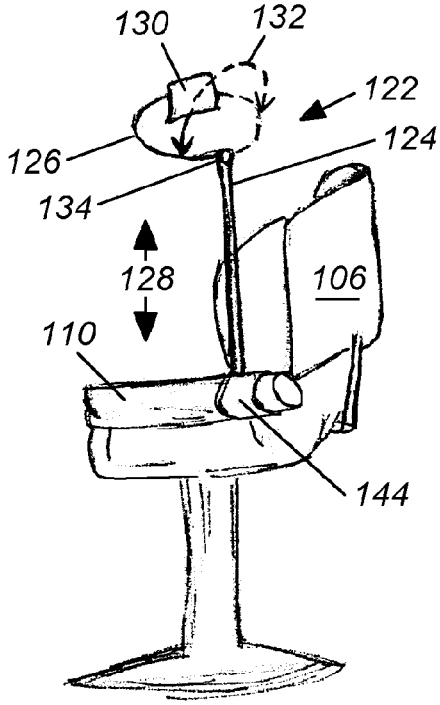
FIG. 18 illustrates the novel headrest being mounted on one of the armrests of the salon chair alternatively to the seat back.

FIG. 18 illustrates the headrest 122 being mounted on one of the armrests 110 of the salon chair 100 alternatively to the seat back 106. Here, an armrest mount 144, for example a band or strap securable about the armrest 110, is secured to the armrest 110. The armrest mount 144 is releasably secured to the armrest 110 so that the headrest 122 can be moved between the armrests 110 on either side of the salon chair 100. The suspension ring 126 suspending the support pad 130 is reversible (arrow 132) between the right and left sides, for example by operation of the hinge or pivot 134 positioned between the suspension ring 126 and support rod 124. The support rod 124 includes either the telescoping or lengthwise repositionable feature (arrow 128) for positioning the height of the suspension ring 126 and support pad 130 relative to the back 106 and seat 108 of the salon chair 100.

The novel adjustable headrest 122 of the invention illustrated in FIGS. 16 through 18 is illustrated in cooperation with the same novel salon chair 100 of the invention that is illustrated in all of FIGS. 9 through 12 and FIG. 14. However, the novel adjustable headrest 122 is optionally utilized instead in cooperation with any other salon chair, including any other salon chair of the prior art and the salon chair 10 disclosed herein. Therefore, salon chairs other than the novel salon chair 100 having the side wings 102, 104 are also contemplated in cooperation with the novel adjustable headrest 122 and may be substituted without deviating from the scope and intent of the present invention.

Sanitary conditions are of utmost importance in salons in general, and particularly in geriatric facilities due to the generally weaker constitution of the elderly and resultant susceptibility to disease. Therefore, the upholstery of the salon chair 100 is a material that can be easily wiped clean and disinfected. For the same reasons, accessories such as the side wings 102, 104 are similarly fabricated from materials that can be easily wiped clean and disinfected. The accessories are optionally finished in the same material as the salon chair 100, with the same or matching color and pattern design. Else the accessories are optionally matched to one another color and design and sold separately from the salon chair 100.

While the preferred and additional alternative embodiments of the invention have been illustrated and described, it will be appreciated that various changes can be made therein without departing from the spirit and scope of the invention. Therefore, it will be appreciated that various changes can be made therein without departing from the spirit and scope of the invention. Accordingly, the inventor makes the following claims.

What is claimed is:

1. A salon chair, comprising:

a salon chair portion comprising a seat portion elevated above a floor surface on a support portion and a seat back portion;

a footrest portion having a foot support portion coupled for translational motion between an extended configuration relative to the seat portion of the chair portion, and a retracted configuration relative thereto, wherein the footrest portion further comprises a leg portion angularly extended away from the seat portion and terminating in the foot support portion distal from the seat portion;

a translational guide mechanism coupled between the chair portion and the footrest portion and being coupled for guiding the footrest portion in a translational manner between the extended and retracted configurations, wherein the translational guide mechanism is structured for translating the leg and foot support portions relative to the chair portion; and an actuator mechanism coupled between the chair portion and the footrest portion and being structured for translating the foot support portion between the extended and retracted configurations; and further comprising one or both of:

one or more side wings extended from the seat back portion adjacent to opposite sides and a top edge thereof and substantially over the seat portion; and an adjustable headrest structured for supporting a head of an occupant of the salon chair from falling.

2. The salon chair of claim 1, further comprising a releasable coupler interconnectable between the seat back portion and at least one of the side wings.

3. The salon chair of claim 2, further comprising a releasable coupler coupled to the seat back portion adjacent to both of the opposite sides thereof, and a cooperating releasable coupler coupled to one of the side wings, wherein the cooperating releasable coupler is alternately releasably coupleable to each of the releasable couplers that are coupled to the seat back portion.

4. The salon chair of claim 2, further comprising a bolster cushion between occupant of the salon chair and at least one of the side wings thereof.

5. The salon chair of claim 1, wherein the adjustable headrest further comprises:

a support rod extended from one of the seat back portion and a armrest portion;

a suspension ring suspended from the support rod; and a support pad coupled to the suspension ring.

6. The salon chair of claim 5, wherein the support pad is further movably coupled to the suspension ring.

7. The salon chair of claim 5, wherein the suspension ring is further rotatably suspended from the support rod.

8. The salon chair of claim 7, wherein the support rod of the adjustable headrest further comprises a means for changing a vertical extension of the suspension ring relative to at least the seat portion of the salon chair.

9. A salon chair, comprising:

a salon chair portion comprising a seat portion elevated above a floor surface on a support portion and both a pair of armrests and a seat back portion extended therefrom;

a translational footrest portion having a leg portion angularly extended away from the seat portion and terminating in a foot support portion, wherein the footrest portion further comprises a sled portion extended from the leg portion adjacent to the underside of the seat portion of the chair portion;

actuating means for actuating the footrest portion in a translational manner between a deployed relationship with the chair portion having the leg portion extended relative to the seat portion of the chair, and a retracted relationship having the leg portion retracted relative to the seat portion; and translational guiding means for translating the footrest portion relative to the chair portion between the deployed relationship and the retracted relationship, wherein the means for guiding the footrest portion further comprises a track fixed relative to the chair portion, the track being extended adjacent to the underside of the seat portion of the chair portion and being further structured to receive the sled portion of the footrest portion for translating there along; and further comprising at least one or both of:

a side wing extended from the seat back portion adjacent to at least one side and a top edge thereof and further extended substantially over the seat portion; and an adjustable headrest structured for supporting a head of an occupant of the salon chair from falling, the adjustable headrest further comprising:

an extensible support rod extended from one of the seat back portion and the armrest portion, the extensible support rod comprising a distal end thereof that is extended above a top edge of the seat back portion;

a suspension ring suspended from the support rod; and a support pad movably coupled to the suspension ring.

10. The salon chair of claim 9, further comprising a releasable coupler mounted on the seat back portion adjacent to each of two opposite sides thereof, and a cooperating releasable coupler mounted on the side wing, wherein the cooperating releasable coupler is alternately releasably coupleable to each of the releasable couplers that are mounted on the sides of the seat back portion, and wherein the side wing is alternately releasably mounted on each of the sides of the seat back portion.

11. The salon chair of claim 10, further comprising a substantially cylindrical bolster cushion positionable between occupant of the salon chair and the side wing thereof.

12. The salon chair of claim 9, wherein the adjustable headrest further comprises a pivot joint between the suspension ring and the support rod.

13. The salon chair of claim 9, wherein the extensible support rod of the adjustable headrest structured further comprises one of:

a receiver bracket secured to the seat back and structured to receive therein a foot portion of the extensible support rod, and an armrest mount securable about the armrest and having the foot portion of the extensible support rod coupled thereto.

14. A method for supporting an occupant in a salon chair, the method comprising:

positioning an occupant in a chair portion of a salon chair structured for being elevated above a floor surface and having a seat portion elevated on a support portion with a seat back portion extended above the seat portion, and both a pair of armrests and a seat back portion extended the seat back portion;

a footrest portion having a foot support portion coupled for translational motion between an extended configuration relative to the seat portion of the chair portion, and a retracted configuration relative thereto, wherein the footrest portion further comprises a leg portion angularly extended away from the seat portion and terminating in the foot support portion distal from the seat portion;

a translational guide mechanism coupled between the chair portion and the footrest portion and being coupled for guiding the footrest portion in a translational manner between the extended and retracted configurations, wherein the translational guide mechanism is structured for translating the leg and foot support portions relative to the chair portion; and an actuator mechanism coupled between the chair portion and the footrest portion and being structured for translating the foot support portion between the extended and retracted configurations; and the method further comprising at least one or both of:

positioning a side wing extended from the seat back portion adjacent to at least one side and a top edge thereof and further extended substantially adjacent to the occupant; and positioning an adjustable headrest for supporting a head of the occupant of the salon chair from falling, and further comprising:

extending a support rod from one of the seat back portion and the armrest portion, and further comprising extending a distal end of the support rod above a top edge of the seat back portion;

suspending a suspension ring from the distal end of the support rod; and movably coupling a support pad to the suspension ring.

15. The method of claim 14, further comprising alternately releasably coupling the side wing to each of the sides of the seat back portion.

16. The method of claim 14, further comprising positioning a substantially cylindrical bolster cushion between the occupant of the salon chair and the side wing thereof.

17. The method of claim 14, further comprising pivoting the suspension ring relative to the support rod.

* * * * *